US010072420B2

(12) United States Patent
Coyle et al.

(10) Patent No.: US 10,072,420 B2
(45) Date of Patent: Sep. 11, 2018

(54) INSULATION MEMBER

(71) Applicant: KEYLITE ROOF WINDOWS LIMITED, Cookstown, Tyrone (GB)

(72) Inventors: Sean Coyle, Cookstown (GB); Aaron McCloskey, Cookstown (GB)

(73) Assignee: Keylite Roof Windows Limited, Cookstown (GB)

( * ) Notice: Subject to any disclaimer, the term of this patent is extended or adjusted under 35 U.S.C. 154(b) by 0 days.

(21) Appl. No.: 14/912,227

(22) PCT Filed: Aug. 18, 2014

(86) PCT No.: PCT/EP2014/067603

§ 371 (c)(1),
(2) Date: Feb. 16, 2016

(87) PCT Pub. No.: WO2015/022435

PCT Pub. Date: Feb. 19, 2015

(65) Prior Publication Data

US 2016/0201328 A1 Jul. 14, 2016

(30) Foreign Application Priority Data

Aug. 16, 2013 (GB) ..... 1314724.4
Aug. 21, 2013 (GB) ..... 1314997.6

(51) Int. Cl.
*E04D 13/03* (2006.01)
*E06B 1/62* (2006.01)
(Continued)

(52) U.S. Cl.
CPC ..... *E04D 13/03* (2013.01); *E04B 1/66* (2013.01); *E04B 1/6801* (2013.01);
(Continued)

(58) Field of Classification Search
CPC .... E06B 1/62; E06B 2001/626; E04B 1/6801; E04B 1/7641; E04B 1/78; E02D 13/03; E02D 13/031
See application file for complete search history.

(56) References Cited

U.S. PATENT DOCUMENTS 4,204,373 A 5/1980 Davidson
4,344,265 A 8/1982 Davidson
(Continued)

FOREIGN PATENT DOCUMENTS

DE 29604195 5/1996
DE 29616505 U1 * 11/1996 ..... E06B 1/62
(Continued)

OTHER PUBLICATIONS

Machine Translation of WO 8894348.
(Continued)

*Primary Examiner* — Christine T Cajilig
(74) *Attorney, Agent, or Firm* — Preston Smirman; Smirman IP Law, PLLC

(57) ABSTRACT

A roof window comprising an insulation member for sealing a gap between at least part of a roof window frame and at least part of a frame of an aperture in a support structure for receiving the roof window frame. The insulation member having a first out of use configuration and a second in use insulating configuration and an arrangement for activating the insulation member between the out of use configuration and the in use insulating configuration.

22 Claims, 9 Drawing Sheets

(51) Int. Cl.

| | |
|---|---|
| ***E04B 1/66*** | (2006.01) |
| ***E04B 1/68*** | (2006.01) |
| ***E04B 1/76*** | (2006.01) |
| ***E04B 1/78*** | (2006.01) |

(52) U.S. Cl.

CPC ..... *E04B 1/7641* (2013.01); *E04B 1/78* (2013.01); *E04D 13/031* (2013.01)

(56) References Cited

U.S. PATENT DOCUMENTS

| | | | | |
|---|---|---|---|---|
| 4,972,638 | A * | 11/1990 | Minter | E04D 13/1475 52/200 |
| 5,394,664 | A * | 3/1995 | Nowell | E04B 1/0046 52/200 |
| 6,256,956 | B1 * | 7/2001 | Davis | E06B 1/62 277/645 |
| 8,764,024 | B2 * | 7/2014 | Deiss | E06B 1/62 277/651 |
| 9,540,802 | B2 * | 1/2017 | Deiss | E04B 1/6812 |
| 2003/0221381 | A1 * | 12/2003 | Ting | E06B 1/02 52/204.1 |
| 2011/0024591 | A1 | 2/2011 | Gordon | |
| 2011/0185661 | A1 * | 8/2011 | Nauck | E06B 1/62 52/309.4 |

FOREIGN PATENT DOCUMENTS

| | | | | |
|---|---|---|---|---|
| DE | 102010055788 | | 6/2012 | |
| EP | 0530653 | A1 * | 3/1993 | E04F 13/06 |
| EP | 2333177 | | 6/2011 | |
| GB | 1274306 | | 5/1972 | |
| GB | 1274306 | A * | 5/1972 | E06B 1/62 |
| WO | 8894348 | | 6/1988 | |
| WO | 0037762 | | 6/2000 | |
| WO | WO 02072990 | A1 * | 9/2002 | E06B 1/62 |

OTHER PUBLICATIONS

Machine Translation of DE 29604195.
Machine Translation of EP 2333177.
Machine Translation of DE 102010055788.
International Search Report dated Dec. 17, 2014.
Written Opinion of the International Searching Authority dated Dec. 17, 2014.
International Preliminary Report on Patentability dated Feb. 16, 2016.

* cited by examiner

INSULATION MEMBER

CROSS-REFERENCE TO RELATED APPLICATION

The instant application is a national phase of PCT International Application No. PCT/EP2014/067603 filed Aug. 18, 2014, and claims priority to GB Patent Application Serial No. 1314724.4 filed Aug. 16, 2013, and GB Patent Application Serial No. 1314997.6 filed Aug. 21, 2013, the entire specifications of all of which are expressly incorporated herein by reference.

The present invention relates to an insulation member for a roof window and in particular to an insulation collar for a roof window.

The thermal transmittance U-value of roof window frames is currently considered to be too high and under certain conditions, the roof window frame material acts as a thermal bridge between the inside and the outside of a building. A significant thermal loss is occurring at the interface between the roof window frame and the roof insulation. In view of the current focus on thermal properties of all building products, this heat loss is a particular problem.

Attempts to solve this thermal loss problem and problems associated with installing the roof windows have been provided by the development of additional installation frames such as L-shaped wooden or foam installation frames or collars to provide support for the roof window and to provide an insulation lining for the aperture cut in the roof to receive the roof window frame. Additionally, bands have been designed for the part of the roof window frame which is buried within the roof structure after installation. These parts are often sold separately as additional products.

The installation of a roof window either retrospectively or during a new build poses significant problems in relation to the thermal insulation of the perimeter of the roof window frame relative to the remainder of the roof structure. It is common practice for the above mentioned insulation collars to be inserted into the framed opening cut into the roof for housing the roof window. A problem that arises by the imprecise nature of cutting a quadrangular aperture in a roof means that there are often gaps between the insulation collar for supporting the frame of the roof window and the frame encasing the opening cut in the roof for receiving the roof window. Traditionally these gaps are plugged with insulation by the roof window installer. Therefore the integrity of this thermal barrier as it is currently created between the insulation collar and the frame encasing the aperture has a number of points of weakness or potential failure. Initially, the accuracy of the aperture cut in the roof as well as the dimensions of the frame can vary during cutting and framing of the aperture and the dimensions of the insulation collars can also vary. As a result, gaps can occur between the insulation collar and the frame encasing the window receiving aperture. Finally, the care taken by the installer to block any naturally occurring gaps with insulation is a weak point especially where certain workers are not as conscientious as others.

It is an object of the present invention to obviate or mitigate the problems of air gaps occurring between a frame encasing a roof window receiving aperture and a roof window frame formed for insertion into the aperture or an insulation collar formed for receiving the roof window frame.

Accordingly, the present invention provides a roof window comprising an insulation member for sealing a gap between at least part of a roof window frame and at least part of a frame of an aperture in a support structure for receiving the roof window frame, the insulation member having a first out of use configuration and a second in use insulating configuration and means for activating the insulation member between the out of use configuration and the in use insulating configuration.

Ideally, the insulation member being pre-fitted on the roof window frame or the aperture frame.

Ideally, the out of use configuration of the insulation member is a collapsed/compressed configuration.

Preferably, the in use insulating configuration of the insulation member is an expanded configuration.

Ideally, the gap is the gap extending between mutually opposing surfaces of the roof window frame and the aperture frame and/or the gap extending between mutually opposing surfaces of a support member of a roof window frame and the aperture frame.

Preferably, the insulation member is mountable on the roof window frame.

Ideally, the insulation member is factory mounted on the roof window frame.

Alternatively, the insulation member is mountable on the aperture frame.

Ideally, the insulation member is mountable on one or more of the mutually opposing surfaces of the roof window frame and the aperture frame.

Ideally, the insulation member is mounted longitudinally along all or a substantial part of the length of one or more of the roof window frame members.

Preferably, the roof window frame has a recess formed for receiving the insulation member.

Ideally, the recess extends longitudinally along all or a substantial part of the length of one or more of the roof window frame members.

Ideally, the recess is formed for receiving the insulation member so that the insulation member is entirely or substantially contained within the external boundary of the roof window frame while in the out of use configuration. Advantageously, this prevents any interaction between the insulation member and the packaging of the roof window frame during factory packaging, shipping or unpacking of the roof window on site. Furthermore, the location of the expandable insulation member within the recess means that there is no interference between the compressed expandable insulation member and the actual aperture frame of the roof during the installation of the roof window into the roof structure. Furthermore, the use of a recessed insulation member means that the same packaging for the roof window can be used without modification to accommodate the new expandable insulation member/collar. A further surprising technical result of providing the insulation member in a recess in the roof window frame is that the overall u-value of the roof window is significantly enhanced because the insulation member is within the body of the roof window frame.

Preferably, the recess is provided by an elongate slot or groove formed in the aperture frame facing surface of the roof window frame.

Ideally, the roof window frame is a wood, plastic, GRP, high density polyurethane or a composite frame member.

Ideally, the insulation member comprises a deformable resilient body compressible into an out of use configuration under a compressive force.

Preferably, the deformable resilient body is expandable into an in use insulating configuration when the compressive force is removed.

Ideally, the means for activating the insulation member between the out of use configuration and the in use insulating configuration comprises a restrictor means for retaining the deformable resilient body in the out of use configuration.

Preferably, the restrictor means further comprises means for releasably fixing the restrictor means to the roof window or aperture frame.

Preferably, the restrictor means comprises a restrictor member.

Ideally, the restrictor member comprises a panel or sheet of material capable of compressing and retaining the deformable resilient body into the out of use configuration.

Ideally, the panel or sheet of material is releasably coupled to the roof window or aperture frame by releasable fixing means.

Preferably, the releasable fixing means comprise low strength adhesive/glue/bonding means or light gauge mechanical fixings such as staples. Advantageously, an operator can easily pull/peel the panel or sheet away from the insulation member allowing the insulation member to expand into the in use insulating position for completion of the roof window installation process.

Ideally, the insulation member comprising a rigid base member one surface of which is engagable with the surface of the window frame and the other surface having the deformable resilient body attachable thereto.

Preferably, the insulation member comprises a deformable resilient body having an upper face, and a lower face, and two lateral faces extending between the upper and lower faces to form a generally quadrangular cross section in the in use insulating configuration.

Ideally, the insulation member extending longitudinally in length to form elongate strips or lengths.

Preferably, the deformable resilient body being adhesively or similarly applied to the rigid base member along at least part of the lower face of the deformable resilient body.

Ideally, a separation layer is locatable on the upper face of the deformable resilient body, distal the lower face applied to the rigid base member.

Preferably, the separation layer comprising paper or other such material. This layer has branding applied thereon.

Ideally, a tape, membrane, or cover is applied across the top of and extendable substantially around the deformable resilient body and rigid base member, enclosing the components therein.

Preferably, the tape, membrane or cover is fastened to the underside of the rigid base member, most preferably adhered/bonded/glued thereto.

Preferably, the tape, membrane, or cover applying a compressive force which compresses the deformable resilient body and maintains this compression.

Ideally, the tape, membrane, or cover being removable to release the deformable resilient body from its compressed state into the in use insulating configuration.

The release of the tape, membrane, or cover being achieved by cutting, ripping, or tearing the tape, membrane, or cover.

Ideally, the tape, membrane, or cover having guide means such as a pre-cut feature, frangible line, rip cord or similar arrangement for assisting the tape, membrane or cover to rip or tear at the correct location.

Preferably, the tape, membrane, or cover being fibreglass lined such that the rips or tears are guided by the fiberglass strands.

Ideally, the separation layer ensuring that the tape, membrane, or cover does not adhere to the insulation member.

Preferably, the tape, membrane, or cover being at least partially transparent. Advantageously, this allows the branding of the separation layer to be visible through the tape, membrane, or cover.

Ideally, the tape is an adhesive tape.

In a second embodiment of insulation member, the insulation member comprises an expandable component expandable in response to operation of the means for activating the insulation member wherein the activating means is a chemical activating means.

Ideally, the chemical activating means is designed for activating a chemical reaction in the material of the insulation member causing the insulation member to expand from the out of use configuration into the in use insulating configuration.

Preferably, the chemical activating means comprises a chemical catalyst housed within a sealed container in fluid communication with the material of the insulation member, the sealed container having a breakable seal.

Ideally, the breakable seal is manually breakable by an operator installing the insulation member. In use, an installer breaks the seal of the sealed container by squeezing pressing or piercing the seal and the chemical catalyst flows into contact with the material of the insulation member expanding the insulation member between the out of use configuration and the in use insulating configuration.

In a third embodiment of the insulation member, the activating means is an inflating means.

In this embodiment, the insulation member comprises an inflatable member.

Preferably, the activating means further comprises an expandable fluid housed within a sealed container in fluid communication with the inflatable member and a breakable seal between the sealed container and the inflatable member.

Ideally, the breakable seal is manually breakable by an operator installing the insulation member. In use, an installer breaks the seal of the sealed container by squeezing pressing or piercing the seal and the fluid expands into the inflatable member expanding the insulation member between the out of use configuration and the in use insulating configuration.

In a fourth embodiment, the activating means comprises a separate movement means operably engageable with the insulation member so as to move the insulation member between the out of use configuration and the in use insulating configuration.

Ideally, the activation means is operable when the roof window is installed.

Ideally, at least part of the insulation member is glued, bonded or adhered to the roof window or aperture frame. Advantageously, in the case of fixing to the roof window frame, this allows the insulation member to be accurately fixed onto the roof window frame in the factory avoiding any issues with incorrect positioning on site.

Ideally, the deformable resilient body comprises a panel of insulation material.

Preferably, the deformable resilient body is formed for engaging at least part of the aperture frame or roof window frame.

Ideally, the deformable resilient body is manufactured from an insulation foam.

Preferably, the deformable resilient body is manufactured from a low density insulation foam.

Ideally, the insulation member is manufactured from an insulation foam.

Preferably, the insulation member is manufactured from a low density insulation foam.

Alternatively, the insulation member is manufactured from medium to high density foam.

Ideally, the insulation member has a protective covering means covering at least part of the surface of the insulation member formed for engaging the aperture frame or the roof window frame.

Preferably, the resilient deformable body has a protective covering means covering at least part of the surface of the resilient deformable body formed for engaging the aperture frame or the roof window frame.

Ideally, the protective covering means is a protective covering sheet.

Preferably, the protective covering sheet is formed from a tough foil or tape. Advantageously, the sheet is resistant to tearing or puncturing during activation of the insulation member from the out of use configuration to the in use insulating configuration. The tough sheet of covering material prevents tearing or crumbling of the foam of the insulation member during activation or rough handling during packaging, transport, storage or unpacking.

Preferably, the protective covering means is a protective covering foil having a corresponding size to all or part of the main longitudinal exposed surface of the resilient deformable body.

Advantageously, the covering foil is a metal or metal alloy sheet.

Accordingly, the present invention provides an insulation collar comprising at least four elongate insulation members as defined above joined about their ends forming a quadrangular shaped insulation collar defining a central aperture, each elongate insulation member having a main aperture facing surface and a main roof facing surface.

In one embodiment of the invention, the insulation member/collar reduces the thermal transmittance U-value of the gap between the roof window frame and the aperture frame by up to 30%.

In another embodiment of the invention, the insulation member/collar reduces the thermal transmittance U-value of the gap between the roof window frame and the aperture frame by up to 40%.

In a further embodiment, the insulation member/collar reduces the thermal transmittance U-value of the gap between the roof window frame and the aperture frame by up to 50%.

In a further embodiment, the insulation member/collar reduces the thermal transmittance U-value of the gap between the roof window frame and the aperture frame by up to 90%.

Preferably, the deformable resilient body has a generally uniform cross section along the length of the member in the in use insulating configuration.

Ideally, the deformable resilient body is provided by one of or any combination of polystyrene, polyurethane, polyisocyanurate or polyethylene.

Ideally, the insulation members are combined into an insulation collar surrounding the perimeter of the roof window frame.

Preferably, the insulation collar has mitre joints at the corners of the roof window frame.

Ideally, the insulation member covers the roof facing surface of the roof window frame housed within the roof.

Preferably, the insulation member covers the roof facing surface of the roof window frame up to or proximal to a point in line with the top of aperture frame on the roof.

Alternatively, the insulation member covers predetermined parts of the roof facing surface of the roof window frame.

Ideally, the insulation member is factory fitted to a roof window frame.

The invention will now be described with reference to the accompanying drawings which show by way of example only four embodiments of an insulation member for a roof window frame in accordance with the invention. In the drawings.

Figure 1:
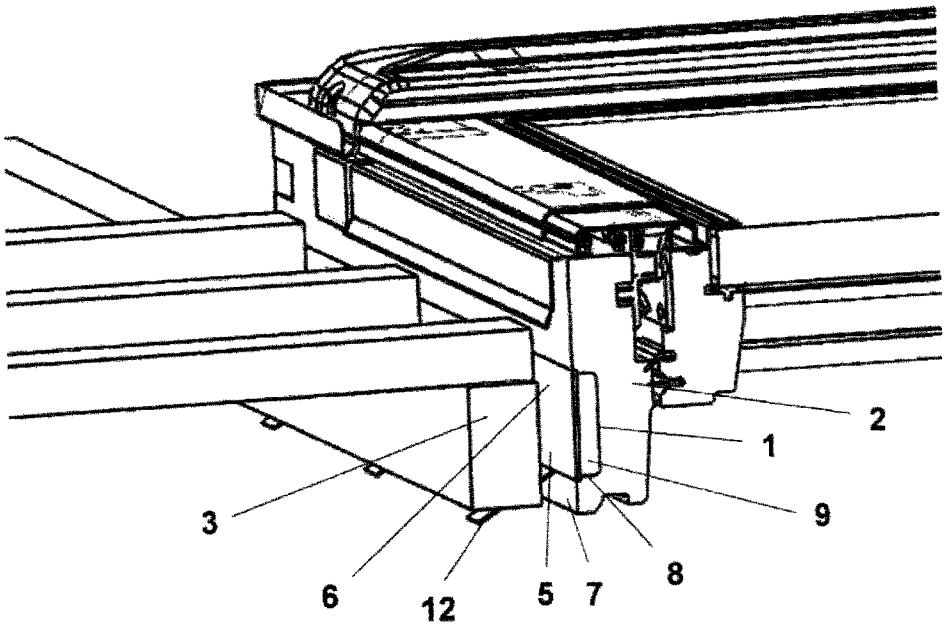
FIG. 1 is a perspective vertical section view of a roof window frame member carrying a recess mounted insulation member in the out of use configuration.

Referring to the drawings generally, there is shown an insulation member indicated by reference numeral 1 for sealing a gap 5 between a roof window frame 2 and a frame 3 surrounding an aperture in a roof structure for receiving the roof window frame 2.

Figure 2:
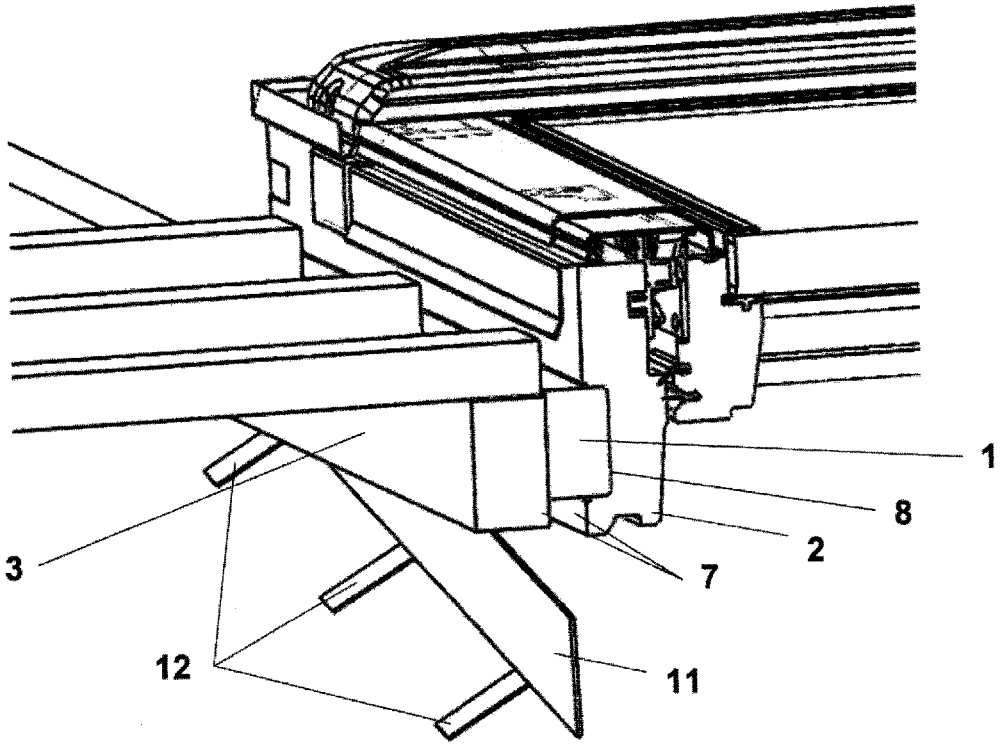
FIG. 2 is a second perspective vertical section view of the roof window frame member of FIG. 1 having a recess mounted insulation member in an in use insulating position engaging the aperture frame.
Figure 3:
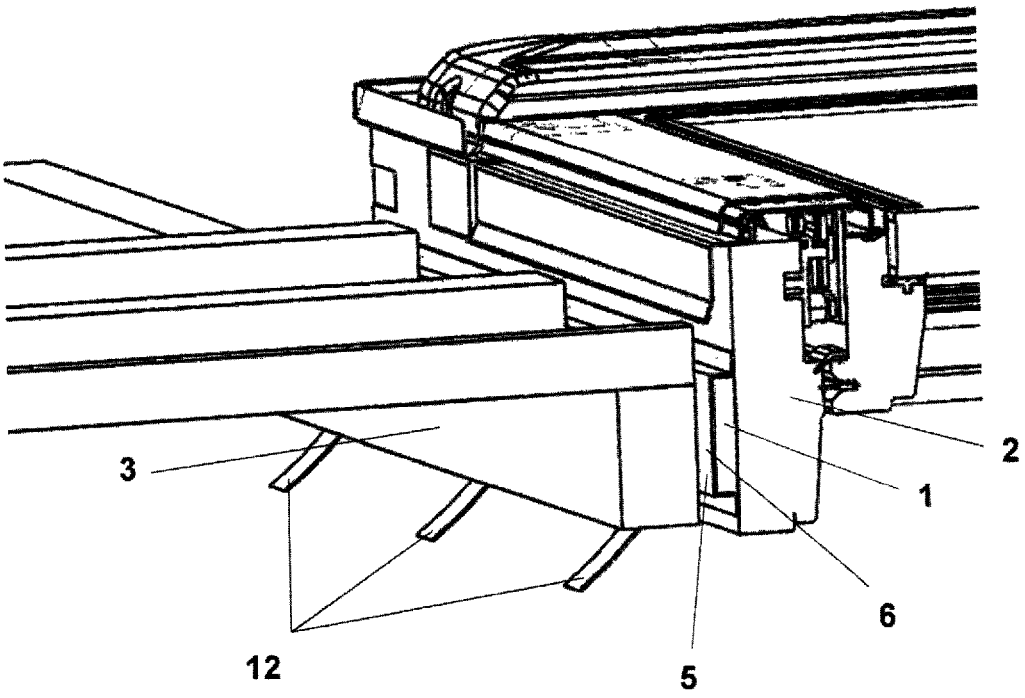
FIG. 3 is a third perspective vertical section view through a roof window frame member having a surface mounted insulation member mounted thereon prior to activation.
Figure 4:
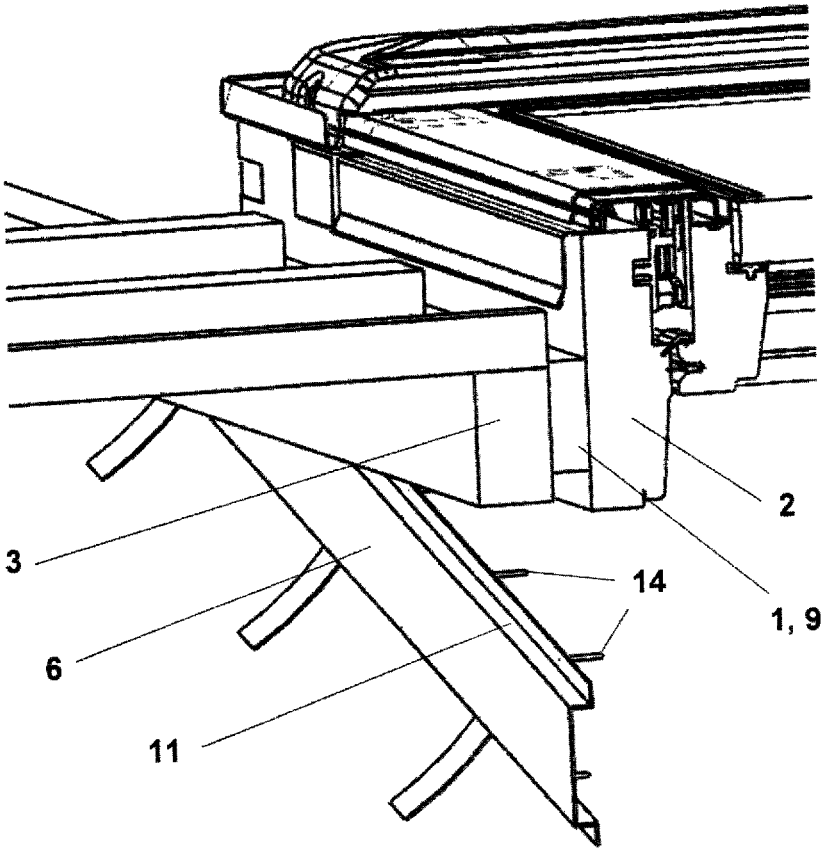
FIG. 4 is a perspective vertical section view through the roof window frame member of FIG. 3 and aperture frame member having the surface mounted insulation member activated via the restriction member.

The insulation member 1 has a first out of use configuration see FIGS. 1 and 3 and a second in use insulating configuration see FIGS. 2 and 4 and an arrangement 6 for activating the insulation member 1 between the out of use configuration and the in use insulating configuration. The out of use configuration of the insulation member 1 is a collapsed configuration and the in use insulating configuration of the insulation member 1 is an expanded configuration. The gap 5 extends between mutually opposing surfaces 7 of the roof window frame 2 and the aperture frame 3. The insulation member 1 is mounted on the roof window frame 2. Alternatively, the insulation member 1 is mounted on the aperture frame 3, not illustrated in the drawings. The insulation member 1 is mounted on one or more of the mutually opposing surfaces 7 of the roof window frame 2 and the aperture frame 3.

Figure 6:
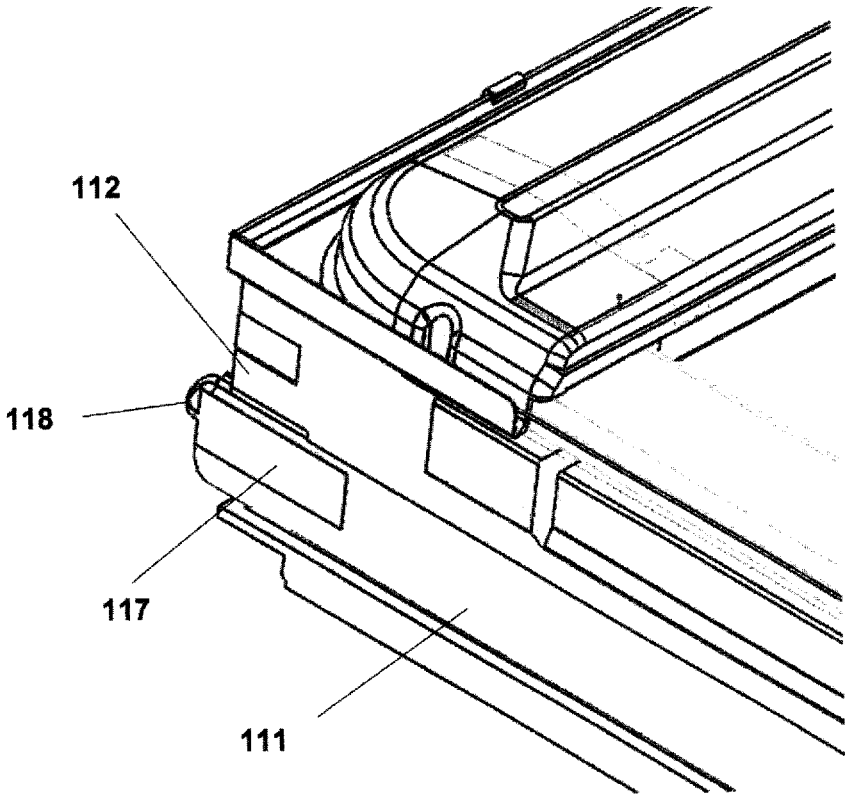
FIG. 6 is a partial perspective view of a roof window frame with the second embodiment of restrictor arrangement having a rip cord.

The roof window frame 2 has a recess 8, see FIGS. 1, 2 and 6 formed for receiving the insulation member 1, 111. The recess 8 is formed for receiving the insulation member 1, 111 so that all or a substantial part of the insulation member 1 is contained within the external boundary of the roof window frame 2 while in the out of use configuration as shown in FIG. 1. Advantageously, this prevents any interaction between the insulation member 1 and the packaging of the roof window frame 2 during factory packaging, shipping or unpacking of the roof window on site and also eliminates the risk of any interference between the insulation member 1 and the aperture frame 3 during installation. The insulation member 1 has a deformable resilient body 9 compressible into an out of use configuration see FIGS. 1 and 3 under a compressive force. The deformable resilient body 9 is expandable into an in use insulating configuration see FIGS. 2, 4 and 9 when the compressive force is removed.

The arrangement 6 for activating the insulation member 1 between the out of use configuration and the in use insulating configuration comprises a restrictor arrangement 11, 12, 14 for retaining the deformable resilient body 9 in the out of use configuration. The restrictor arrangement 11, 12, 14 has members 12, 14 for releasably fixing the restrictor arrangement 11, 12, 14 to the roof window 2 or aperture frame 3. The restrictor arrangement 11, 12, 14 has a restrictor member 11.

The restrictor member 11 is a thin, flat panel or sheet of material capable of compressing and retaining the deformable resilient body 9 into the out of use configuration as clearly illustrated in FIGS. 1 and 3. The panel or sheet 1 of material is releasably coupled to the roof window 2 or aperture frame 3 by releasable fixing members 12, 14. The releasable fixing members comprise low strength adhesive/bond/glue strips 12 or light gauge mechanical fixings such as staples 14. Advantageously, an operator can easily pull/peel the panel or sheet 11 away from the insulation member 1 allowing the insulation member 1 to expand into the in use insulating position for completion of the roof window installation process.

Figure 5:
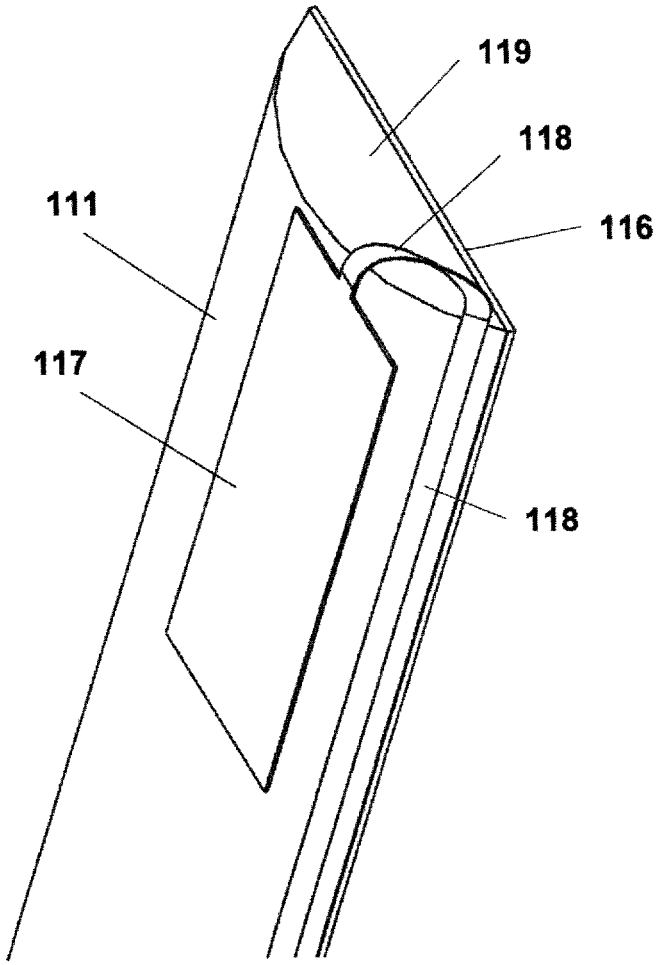
FIG. 5 is a partial perspective view of a second embodiment of restrictor arrangement having a rip cord.
Figure 7:
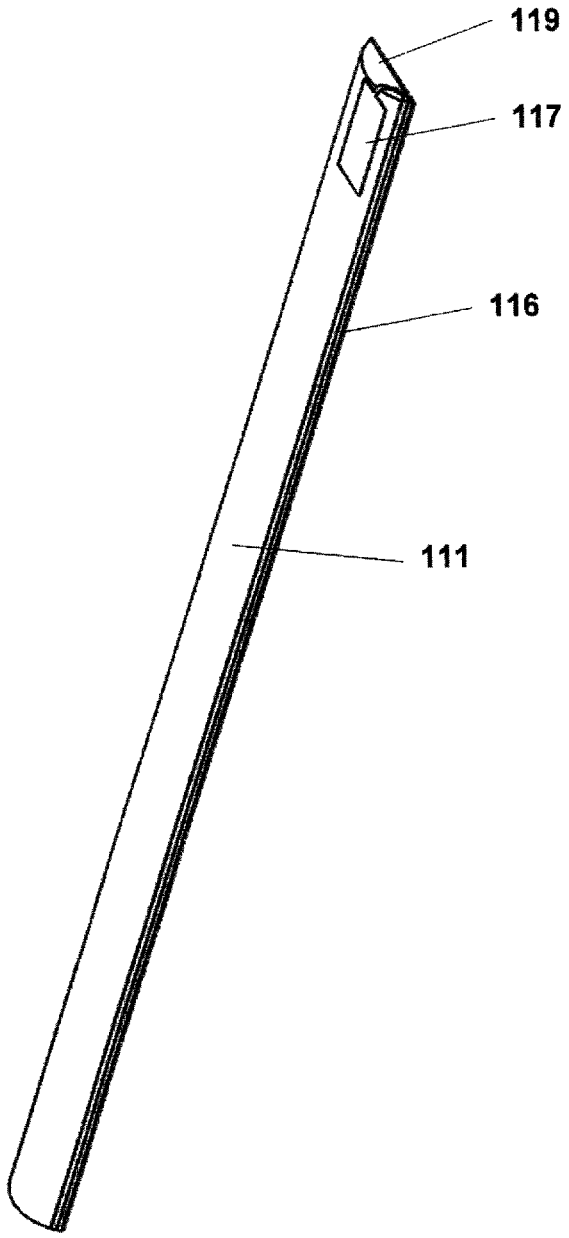
FIG. 7 is a perspective view of the second embodiment of insulation member.

In an alternative configuration of restrictor member as illustrated in FIGS. 5 to 7, the restrictor member 111 is a thin flexible sheet of material capable of compressing and retaining a deformable resilient body 119 into the out of use configuration on a support member 116 as illustrated in FIG. 6. The flexible sheet 111 is glued, adhered or bonded to the support member 116. The support member 116 is coupled to the roof window 112 or aperture frame 3 by a suitable fastening arrangement, not shown. This fastening arrangement comprises low strength adhesive/glue/bond such as strips or light gauge mechanical fixings such as staples 14 similar to those illustrated in FIGS. 1 to 4. This restrictor member 111 has a pull cord 118 and a pull cord tab 117. The pull cord 118 extends along all or a substantial part of the length of the flexible sheet 111 and tears the flexible sheet away from the resilient body 119 allowing the resilient body to expand into and fill the gap between roof window frame 2 and aperture frame 3. Advantageously, an operator can easily pull the rip cord tab 117 away from the insulation member 1 allowing the insulation member 1 to expand into the in use insulating position for completion of the roof window installation process. This insulation member 1 is surface mounted or is mounted in a recess on the frame 2.

Figure 8:
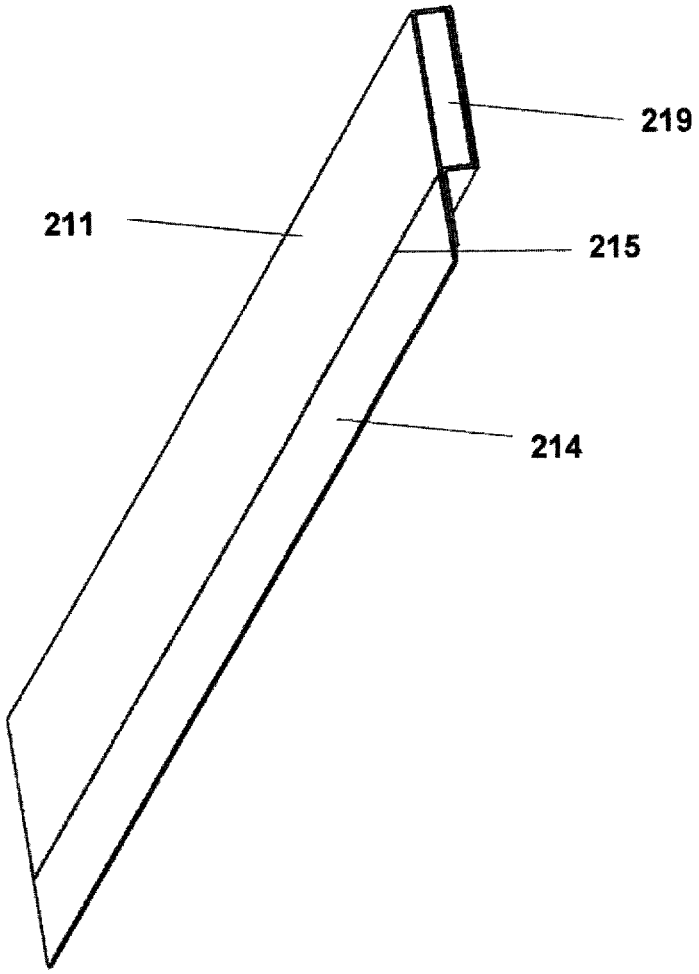
FIG. 8 is a perspective view of a third embodiment of restrictor arrangement having a pull away flap.

In an alternative configuration of restrictor member as illustrated in FIG. 8, the restrictor member 211 is a box of sheets/panels capable of compressing and retaining a deformable resilient body 219 into the out of use configuration within the box as illustrated in FIG. 8. The box 211 is coupled to or recessed into the roof window 112 or aperture frame 3 by a suitable fastening arrangement, not shown. This fastening arrangement comprises low strength adhesive/glue/bond such as strips or light gauge mechanical fixings such as staples 14 similar to those illustrated in FIGS. 1 to 4. This restrictor member 111 has a tear away flap 214 coupled to the box 211 along a frangible line 215 extending along one edge of the box 211. The frangible line 215 extends along all or a substantial part of the length of the edge of the box 211 and when the tear away flap 214 is ripped along the frangible line 215 this tears the box open away from the resilient body 219 allowing the resilient body 219 to expand into and fill the gap between roof window frame and aperture frame. Advantageously, an operator can easily pull the tear away flap 214 away from the insulation member 1 allowing the insulation member 1 to expand into the in use insulating position for completion of the roof window installation process. This insulation member 1 is surface mounted or is mounted in a recess on the frame 2.

In an embodiment of insulation member not shown in the drawings, the insulation member comprises an expandable component expandable in response to operation of the activating arrangement wherein the activating arrangement is a chemical activator. The chemical activator is designed for activating a chemical reaction in the material of the insulation member causing the insulation member to expand from the out of use configuration into the in use insulating configuration. The chemical activator is a chemical catalyst housed within a sealed container in fluid communication with the material of the insulation member, the sealed container having a breakable seal. The breakable seal is manually breakable by an operator installing the insulation member. In use, an installer breaks the seal of the sealed container by squeezing pressing or piercing the seal and the chemical catalyst flows into contact with the material of the insulation member expanding the insulation member between the out of use configuration and the in use insulating configuration.

In a third embodiment of insulation member not shown in the drawings, the activator is an inflating arrangement. The insulation member is an inflatable member. The activator further has an expandable fluid housed within a sealed container in fluid communication with the inflatable member and a breakable seal between the sealed container and the inflatable member. The breakable seal is manually breakable by an operator installing the insulation member. In use, an installer breaks the seal of the sealed container by squeezing pressing or piercing the seal and the fluid expands into the inflatable member expanding the insulation member between the out of use configuration and the in use insulating configuration.

In a fourth embodiment not shown in the drawings, the activator comprises a separate movement arrangement operably engageable with the insulation member so as to move the insulation member between the out of use configuration and the in use insulating configuration.

At least part of the insulation member 1 is glued, bonded or adhered to the roof window 2 or aperture frame 3. Advantageously, in the case of fixing to the roof window frame 2, this allows the insulation member 1 to be accurately fixed onto the roof window frame 2 in the factory avoiding any issues with incorrect positioning on site. The deformable resilient body 9 comprises a panel of insulation material. The deformable resilient body 9 is formed for engaging at least part of the aperture frame 3 or roof window frame 2. The deformable resilient body 9 is manufactured from an insulation foam. The deformable resilient body 9 is manufactured from a low density insulation foam. The insulation member 1 is manufactured from an insulation foam. The insulation member 1 is manufactured from a low density insulation foam. Alternatively, the insulation member 1 is manufactured from medium to high density foam.

The insulation member 1 has a cover covering at least part of the surface of the insulation member 1 formed for engaging the aperture frame 3 or the roof window frame 2. The cover is a covering sheet. The sheet is formed from a tough foil or tape comprising cloth, PVC, polythene, polyisobutylene, polyester, polypropylene or any combination of these. Advantageously, the sheet is resistant to tearing or puncturing during activation of the insulation member 1 from the out of use configuration to the in use insulating configuration. The tough sheet of covering material prevents tearing or crumbling of the foam of the insulation member during activation or rough handling during packaging, transport, storage or unpacking. The cover is a covering foil having a corresponding size to all or part of the main longitudinal exposed surface of the insulation member 1. Advantageously, the covering foil is an aluminium foil.

Figure 9:
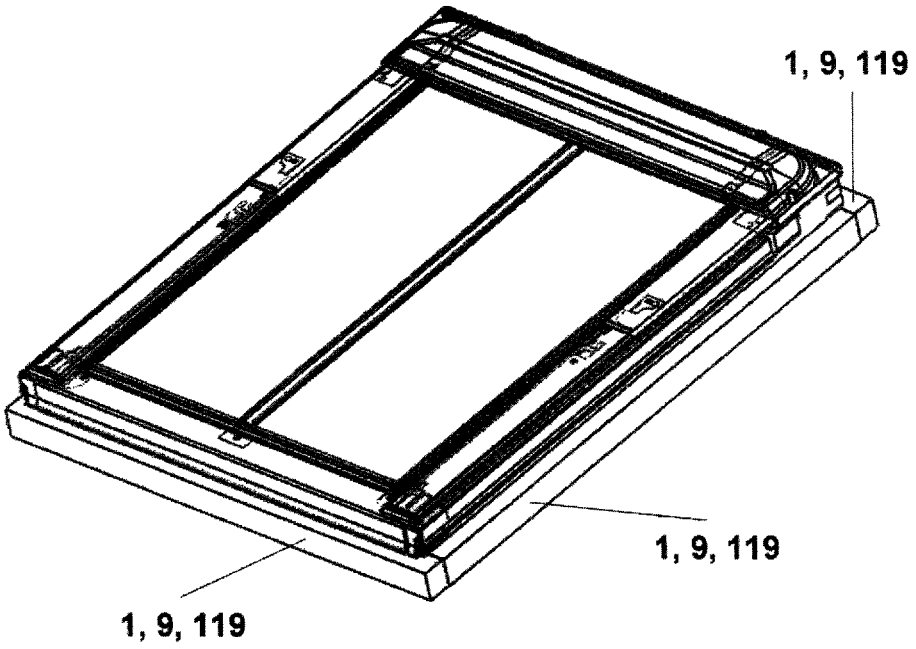
FIG. 9 is a perspective view of a roof window frame with an insulation collar around the perimeter of the frame.

An insulation collar is illustrated in FIG. 9 provided by four elongate insulation members 1 as defined above joined about their ends forming a quadrangular shaped insulation collar defining a central aperture, each elongate insulation member 1 having a main aperture facing surface and a main roof facing surface. In one embodiment of the invention, the insulation member/collar 1 reduces the thermal transmittance U-value of the gap between the roof window frame and the aperture frame by up to 30%. In another embodiment of the invention, the insulation member/collar reduces the thermal transmittance U-value of the gap between the roof window frame and the aperture frame by up to 40%. In a further embodiment, the insulation member/collar reduces the thermal transmittance U-value of the gap between the roof window frame and the aperture frame by up to 50% or up to 90%.

The insulation member 1 has a generally uniform cross section along the length of the member 1. The insulation member 1 is provided by one of or any combination of polystyrene, polyurethane, polyisocyanurate or polyethylene. The insulation members 1 are combined into an insulation collar surrounding the perimeter of the window frame 2. The insulation collar has mitre joints at the corners of the roof window frame 2. The insulation member 1 covers the roof facing surface of the window frame 2 housed within the roof. The insulation member 1 covers the roof facing surface of the window frame 2 up to a point in line with the top of batons on the roof. Alternatively, the insulation member 1 covers predetermined parts of the roof facing surface of the window frame 2. It will of course be appreciated that the insulation member 1 could cover similar portions of the aperture facing surface of the aperture frame 3. The insulation member is designed with a resilient deformable body being capable of expanding to 105 greater that the gap between the roof window frame and the aperture frame. The foam is designed to expand up to 50 mm from the surface of the roof window frame, although up to 40 mm and 30 mm would be sufficient in certain situations. Alternatively, the foam is designed to expand up to 50 mm in a fully expanded condition, although up to 40 mm and 30 mm would be sufficient in certain situations.

In relation to the detailed description of the different embodiments of the invention, it will be understood that one or more technical features of one embodiment can be used in combination with one or more technical features of any other embodiment where the transferred use of the one or more technical features would be immediately apparent to a person of ordinary skill in the art to carry out a similar function in a similar way on the other embodiment.

In the preceding discussion of the invention, unless stated to the contrary, the disclosure of alternative values for the upper or lower limit of the permitted range of a parameter, coupled with an indication that one of the said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof as defined in the appended claims.

The invention claimed is:

1. A roof window, comprising:

a roof window frame and a roof window sash, the roof window frame having a top member, a bottom member and two side members extending between the top and bottom members defining a roof window frame having an opening for receiving the roof window sash, the roof window sash having a top member, a bottom member and two side members extending between the top and bottom member defining a quadrangular roof window sash frame having an opening for receiving a pane of glass, the roof window sash frame being mounted to the roof window frame and being movable between a closed position and an open position, the roof window frame comprising an inset portion to be inset in a frame of an aperture in a support structure for receiving the roof window and an outset portion to be outset from the frame of the aperture in the support structure for receiving the roof window, the roof window sash frame opening for receiving a pane of glass being located coplanar with a part of the outset portion when the roof window sash frame is in the closed position, the roof window further comprising an insulation member for sealing a gap between at least part of the roof window frame and at least part of a frame of an aperture in a support structure for receiving the roof window frame, the insulation member having a first out of use configuration and a second in use insulating configuration and means for activating the insulation member between the out of use configuration and the in use insulating configuration, the means for activating the insulation member between the out of use configuration and the in use insulating configuration further comprising a restrictor means for retaining the insulation member in the out of use configuration, the insulation member being located on the inset portion of the roof window frame.

2. The roof window as claimed in claim 1, wherein the insulation member is pre-fitted on the roof window frame.

3. The roof window as claimed in claim 1, wherein the out of use configuration of the insulation member is a collapsed/compressed configuration and wherein the in use insulating configuration of the insulation member is an expanded configuration.

4. The roof window as claimed in claim 1, wherein the gap is the gap extending between mutually opposing surfaces of the roof window frame and the aperture frame and/or the gap extending between mutually opposing surfaces of a support member of a roof window frame and the aperture frame.

5. The roof window as claimed in claim 1, wherein the roof window frame has a recess formed for receiving the insulation member.

6. The roof window frame as claimed in claim 5, wherein the recess is provided by an elongate slot or groove formed in the aperture frame facing surface of the roof window frame.

7. The roof window as claimed in claim 6, wherein the recess is formed for receiving the insulation member so that the insulation member is entirely or substantially contained within the external boundary of the roof window frame while in the out of use configuration.

8. The roof window as claimed in claim 1, wherein the insulation member comprises a deformable resilient body compressible into an out of use configuration under a compressive force, the deformable resilient body being expandable into an in use insulating configuration when the compressive force is removed.

9. The roof window as claimed in claim 1, wherein the restrictor means further comprises means for releasably fixing the restrictor means to the roof window or aperture frame.

10. The roof window as claimed in claim 1, wherein the restrictor means comprises a panel or sheet of material capable of compressing and retaining the deformable resilient body into the out of use configuration.

11. The roof window as claimed in claim 10, wherein the panel or sheet of material is releasably coupled to the roof window or aperture frame by releasable fixing means.

12. The roof window as claimed in claim 8, wherein the insulation member comprises a rigid base member one surface of which is engagable with the surface of the window frame and the other surface having the deformable resilient body attachable thereto.

13. The roof window as claimed in claim 1, wherein the insulation member extends longitudinally in length to form elongate strips or lengths.

14. The roof window as claimed in claim 12, wherein the deformable resilient body being adhesively applied to the rigid base member along at least part of the lower face of the deformable resilient body.

15. The roof window as claimed in claim 12, wherein a tape, membrane, or cover is applied across the top of and extendable substantially around the deformable resilient body and rigid base member, enclosing the components therein.

16. The roof window as claimed in claim 15, wherein the tape, membrane or cover is fastened to the underside of the rigid base member.

17. The roof window as claimed in claim 1, wherein the activating means is operable when the roof window is installed.

18. The roof window as claimed in claim 1, wherein at least part of the insulation member is glued, bonded or adhered or otherwise mechanically fixed to the roof window.

19. The roof window as claimed in claim 8, wherein the deformable resilient body comprises a panel of insulation foam.

20. The roof window as claimed in claim 1, wherein the insulation member has a protective covering means covering at least part of the surface of the insulation member formed for engaging the aperture frame or the roof window frame.

21. The roof window as claimed in claim 20, wherein the protective covering means is a sheet formed from a tough foil or tape.

22. A roof window comprising a roof window frame and a roof window sash, the roof window frame having a top member, a bottom member and two side members extending between the top and bottom members defining a roof window frame having an opening for receiving the roof window sash, the roof window sash having a top member, a bottom member and two side members extending between the top and bottom member defining a quadrangular roof window sash frame having an opening for receiving a pane of glass, the roof window sash frame being mounted to the roof window frame and being movable between a closed position and an open position, the roof window frame comprising an inset portion to be inset in a frame of an aperture in a support structure for receiving the roof window and an outset portion to be outset from the frame of the aperture in the support structure for receiving the roof window, the roof window sash frame opening for receiving a pane of glass being located coplanar with a part of the outset portion when the roof window sash frame is in the closed position, the roof window further having an insulation collar, comprising at least four elongate insulation members as claimed in claim 1, combined about their ends forming a quadrangular shaped insulation collar, the insulation collar being located on the inset portion of the roof window frame.

* * * * *